US006261392B1

(12) United States Patent
Sundgren et al.

(10) Patent No.: US 6,261,392 B1
(45) Date of Patent: Jul. 17, 2001

(54) METHOD FOR MANUFACTURING QUENCHED THIN-WALLED METAL HOLLOW CASING BY BLOW-MOULDING

(75) Inventors: Anders Sundgren, Sunderbyn; Mats Lindberg, Luleå; Göran Berglund, Gammelstad, all of (SE)

(73) Assignee: Accra Teknik AB (SE)

( * ) Notice: Subject to any disclaimer, the term of this patent is extended or adjusted under 35 U.S.C. 154(b) by 0 days.

(21) Appl. No.: 09/424,235

(22) PCT Filed: Apr. 23, 1998

(86) PCT No.: PCT/SE98/00742

§ 371 Date: Mar. 20, 2000

§ 102(e) Date: Mar. 20, 2000

(87) PCT Pub. No.: WO98/54370

PCT Pub. Date: Dec. 3, 1998

(30) Foreign Application Priority Data

May 30, 1997 (SE) ..... 9702058

(51) Int. Cl.[7] ..... C21D 8/10

(52) U.S. Cl. ..... 148/590; 148/594

(58) Field of Search ..... 148/590, 594, 148/570; 72/61, 709

(56) References Cited

FOREIGN PATENT DOCUMENTS 64771 2/1927 (DE) .
1 490 535 11/1977 (SE) .

*Primary Examiner*—Deborah Yee
(74) *Attorney, Agent, or Firm*—Bacon & Thomas PLLC

(57) ABSTRACT

The invention concerns a method for manufacturing quenched metal hollow casings of steel by blow-moulding whereby a preheated hollow casing billet, preferably above austenitising temperature, is introduced into a blow-moulding tool (1) and moulded by being expanded against the inner walls of the tool by the introduction of a preheated, pressurized medium into the interior cavity of the hollow casing, whereby the moulded hollow casing (6) is rapidly cooled in a process adapted to obtain quenching of the steel material by the dominating heated medium in the hollow casing being replaced by a pressurized cooling medium and that a cooling medium is led through the moulding tool to achieve its cooling.

9 Claims, 3 Drawing Sheets

METHOD FOR MANUFACTURING QUENCHED THIN-WALLED METAL HOLLOW CASING BY BLOW-MOULDING

BACKGROUND OF THE INVENTION

The present invention concerns a method for manufacturing quenched thin-walled metal hollow casings by blow-moulding.

A blow-moulding method for manufacturing metal hollow casings in one piece is previously known from SE 64 771, whereby the heated casing is expanded in a heated moulding by means of introducing a heated pressurized medium such as pressurized air, steam or other gaseous medium, so that the shape thus expands to match that of cavities arranged in the moulding. Since the shaping of the material takes place at high temperature, it is not only the actual formability of the material that increases, but the formation of the shape also occurs without the structure of the material being changed as long as this formation takes place at a temperature above the recrystallization temperature of the material. Because of this, tubular items can be produced with complex shapes in thin materials and with very good size accuracy.

Within the motor industry in particular, there has long been a wish to produce by a simple and cheap means and using thin-walled low alloy steel casing (less than 3 mm thick) quenched hollow casings in one piece as a replacement for the casings pressed and quenched to form suitable sheet billets, primarily flat and relatively thin billets, that, when joined together, form the load-bearing and protective frame components of a vehicle's body.

A common factor for the currently known tubular beam constructions is that they are expensive in manufacture due to the necessity of an extra manufacturing operation, namely the welding or gluing when the sheet billets are joined together. In addition, due to their joined-together design, the said beam constructions can in certain circumstances display construction weaknesses caused by notch effects and consequent problems of metal fatigue. In general, the stiffness performance is adversely affected in beam constructions manufactured according to the known technique.

As the manufacturing cost for the components that form part of a vehicle's safety cage, such as beams and their associated joining elements, has until now been very high in relation to the total cost of manufacture for the vehicle, it has not been possible to design these in an optimal way for the safety of those travelling in the vehicle. This all adds up to a major problem for the car industry, especially as the product life cycle for a vehicle has become shorter at the same time as concerns for safety have become more intense.

In addition to the said known technical difficulties in production associated with the manufacture of the said beam constructions mentioned above, the constructions have, due to the irregular shape at the location of the joints, sharp folds and cavities that increase the chance of corrosion and that are not easily accessible during treatment of the surfaces. In addition, the irregular form of known beam constructions increases their weight compared with the equivalent uniform item developed as one piece. Through the use of these known components, the weight of the car itself plus the possible payload will also increase, so that even the fuel consumption of the car will increase due to the greater engine performance that is thus required.

As mentioned above, such tubular beam constructions and similar elements have until now been manufactured by joining together sheet billets pressed in to suitable shapes whose moulding is previously known to employ that known as a pressing and quenching procedure, whereby both the moulding and the quenching of a sheet billet to produce the finished shape are performed in one and the same moulding tool. The main advantage of the said pressing and quenching procedure is that the item can be used directly in the quenched state without the requirement of subsequent tempering. It has proven to be particularly suitable to use carbonised manganese steel such as boron steel for this type of manufacturing process as this type of steel has very good quenching characteristics due to the addition of boron.

Such a manufacturing process is known, for example, through SE 435 527 whereby the starting material is a low alloy sheet billet, preferably a steel containing less than 0.4% carbon, silicon in an amount dependent on the method for manufacturing the steel but that is otherwise not critical, 0.5–2.0% manganese, a maximum of 0.05% phosphorous and a maximum of 0.05% sulphur, 0.1–0.5% chrome and/or 0.05–0.5% molybdenum, up to 0.1% titanium, 0.0005–0.01% boron, up to a maximum of totally 0.1% aluminium plus possible low concentrations of copper and nickel, possibly in amounts up to 0.2% each, whereby the material is heated to austenitising temperature, preferably 775–1000° C. The sheet billet is then placed between two tools in a press and imparted with a significant change of shape by the tools being forced against each other by means of the press, and via rapid cooling of the tools to obtain an indirect rapid cooling of the billet, whereby this is quenched while remaining in the tool so that a martensitic and/or bainitic, preferably fine grain, structure is obtained.

It should be understood that this method is only applicable with flat, essentially plane shapes with a large surface area to lead away the heat and not, as in the case of the present invention concerning hollow casings, i.e. enclosed tubular shapes with surfaces that are relatively small and difficult to access to obtain a rapid cooling down of the billet by effectively leading away the heat.

Thus, the technique described in the said SE 64 771 named above does not refer to a method for achieving the sought-after kind of quenched, high strength hollow casing, in other words hollow casings of quenched steel formed in one piece. Neither does SE 435 527 give any guidance in this direction.

SUMMARY OF THE INVENTION

As mentioned above, the present invention yields thin-walled metal hollow casings intended to form beams and their associated joining elements for forming the frame parts that are included in a car body.

One objective of the present invention is thus to achieve a manufacturing method that allows the manufacture of hollow casings of quenched steel in one piece using the basis of the technique described in SE 64 771 and that previously known from SE 435 527.

In common with the steel used in that known as the pressing and quenching process, the application of the method according to the invention is primarily intended for use with boron alloy carbonised steel or carbonised manganese steel to obtain the desired combination of hardness and rigidity at the same time as a subsequent tempering stage is avoided.

BRIEF DESCRIPTION OF THE DRAWINGS

The invention is described as follows in greater detail with reference to the attached drawings, where FIG. 1 in a very schematic manner shows a longitudinal cross-section of an arrangement for performing the first stage of the method according to the invention.

DETAILED DESCRIPTION OF THE PREFERRED EMBODIMENTS

Figure 1:
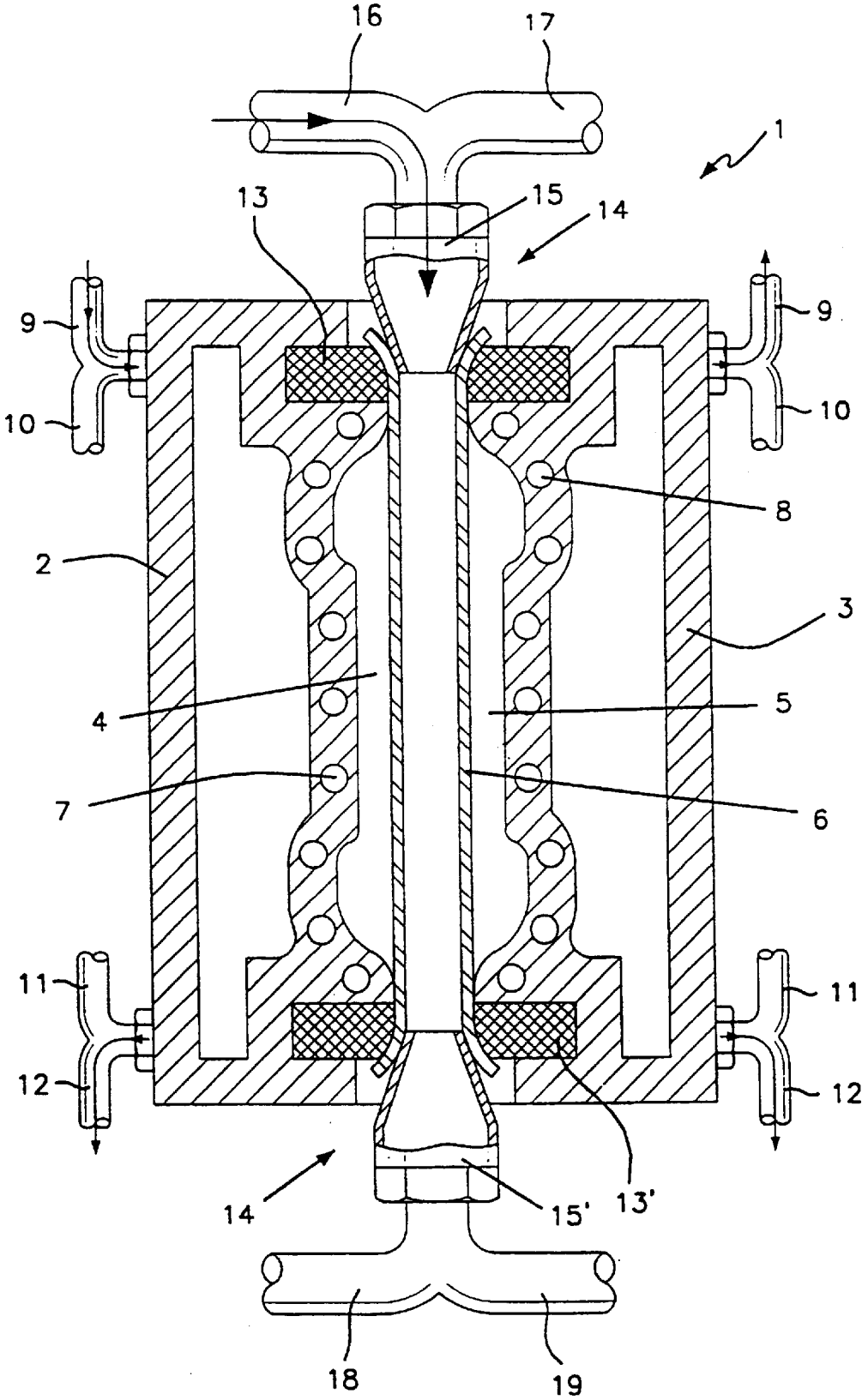
FIG. 1*a* shows one part of the arrangement shown in FIG. 1 during a part of the process.

In accordance with the principles that form the basis of the present invention and with reference to the drawings in the figures, an arrangement for performing the method includes a moulding tool generally designated 1 in the form of two interacting tool halves 2, 3 in which are arranged the respective cavity halves 4, 5 for forming an essentially smooth cylindrical hollow casing billet 6 inserted between them that is preheated and intended to be moulded against the inner walls of cavity halves 4, 5 through the introduction of air to its interior. This hollow casing billet 6 comprises a thin-walled tube open at the ends and preferably with a material thickness of less than 3 mm and composed of a suitably quenchable material, preferably a boron steel. The hollow casing billet 6 is preferably a solid, seamless format but it can also be of a welded type and, if so, preferably heat treated by stress-relieving annealment.

Channels 7, 8 are arranged in each half 2, 3 of the moulding tool 1 for the circulation of either warm or cold water for heating or cooling respectively of the moulding tool 1 during the moulding process. For feeding in and removing this medium, one end of the respective channel 7, 8 is connected partly to a first inlet pipe 9 for the heating medium that can comprise, for example, heated liquid or steam, and partly to a second inlet pipe 10 for the cooling medium that preferably comprises water. Similarly, the other end of the said channels 7, 8 is connected partly to a first outlet pipe 11 for the cooling medium and partly to a second outlet pipe 12 for the heating medium.

The said inlet and outlet pipes also have their associated respective controlling device, not shown in the figures, for steering the flow between the first and the second inlet pipes 9, 10 so that one can select whether either the heating medium or the cooling medium will flow through channels 7, 8. In this way, the flow through the respective channels 7, 8 in the moulding tool halves 2, 3 can very quickly be switched so that the flow very efficiently heats or cools the moulding tool 1 depending on whether the flow comprises the heating medium or the cooling medium.

In addition, the moulding tool 1 or, more specifically, its respective halves 2, 3 are, in what is a per se known manner, provided with slots or openings, not shown in the figures, so that the air enclosed between the hollow casing billet 6 and the inner wails of cavity halves 4, 5 during the forming process can disperse, as well as with separable sealing rings 13, 13' at their first and second inlet positions designated 14, 14' for respective nozzles 15, 15' intended for introducing the medium to the hollow casing billet's 6 interior as well as leading this medium away via the hollow casing billet's 6 open ends.

A first inlet pipe 16 for a heating gaseous medium is partly connected to one of the nozzles 15, as is a second inlet pipe 17 for an essentially cooling gaseous medium, where in both cases, the medium preferably comprises air. The other nozzle 15' is partly connected to a first outlet pipe 18 for the cooling medium and partly to a second outlet pipe 19 for the heating medium.

The said inlet pipes 16, 17 and outlet pipes 18, 19 also have their associated respective controlling device, not shown in the figures, for steering the flow between the said pipes so that the alternative flow paths at the inlet respectively outlet can be selected, whereby a heated gaseous medium introduced into the interior of the hollow casing billet 6 to cause its expansion can rapidly be replaced with a cooling medium. In addition, both nozzles 15, 15' can, of course, be closed-off so that no medium can flow through them.

The method according to the invention is carried out as follows:

The hollow casing billet 6, which comprises what is a per se previously known steel material, is heated to quenching temperature, i.e. to a temperature above $Ac_3$, whereby the steel material takes up an austenitic condition. The steel is preferably heated to a temperature between 775 and 1000° C.

As illustrated in FIG. 1, the heated smooth hollow casing billet 6 is introduced between the halves of the moulding tool 2, 3 and these are pressed against each other to a position that produces an enclosed form. It is advantageous if the said halves of the moulding tool are pre-heated by means of heated medium flowing through channels 7, 8 so that the moulding tool 1 itself does not cool down the hollow casing billet 6 to any great extent. Following this, the nozzles 15, 15' are introduced into openings at each end of the hollow casing whereby the sealing between the respective end and nozzle 15, 15' takes place by means of the sealing rings 13, 13'. When the pre-heated gaseous medium is introduced into the hot hollow casing billet's 6 interior via nozzle 15, as illustrated by the directional arrow in FIG. 1, the billet is moulded against the inner walls of the moulding cavity 4, 5. It should be understood that nozzle 15 is at this time closed-off and that medium can thus not flow out from the hollow casing billet's 6 interior. The pressure required to achieve a good moulding of the hollow casing billet against the inner walls of the moulding cavity is to a large extent dependent on the type and characteristics of the steel, but also on the starting billet's dimensions, primarily the original inner volume and the thickness of the casing. In general, it can be said that blow-moulding of thin-walled casings of the type of steel recommended above should suitably lie within the range 30–80 MPa, in other words, a comparatively low pressure.

It should nevertheless be pointed out that while the pressures given above are theoretically sufficient to achieve the required force of pressure for carrying out the blow-moulding, a suitable pressure in practice should be somewhat greater for the blow-moulding to take place with a rapidity that does not cause initial cooling of the billet against the inner walls of the cavity halves 4, 5 to begin before the moulding process is fully complete.

Figure 1A:
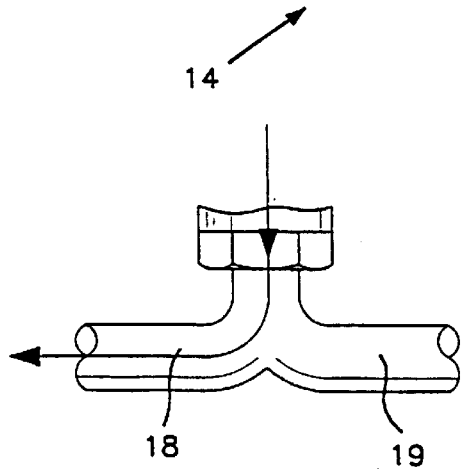

To thereafter achieve a cooling that is efficient for carrying out the quenching process, the hollow casing billet 6 is quickly cooled both on the outside and the inside. The quenching of the hollow casing billet 6 takes place in that the gas dominating the interior is, as illustrated in FIG. 1*a,* led out via nozzle 15''s outlet pipe 18 and replaced by a cooling gaseous medium, preferably air, that is introduced via nozzle 15's inlet pipe 17 as illustrated with the directional arrow in FIG. 2. At the same time, even the moulding tool's 1 halves 2, 3 are cooled by an essentially cooling medium, preferably water, being led through the channels 7, 8 of these halves.

The quenching or, more precisely, the cooling of the moulded hollow casing billet 6 should be carried out rapidly so that a fine grain martensitic and/or bainitic structure is obtained. The speed of cooling required is dependent on the chemical composition of the steel and thereby its CCT (Continuous Cooling Transformation) diagram. The cooling of the hollow casing billet 6 is carried out with it remaining in the moulding cavity and under the maintenance of a very high pressure, even of the medium that is located in the interior of the hollow casing billet, whereby the moulding itself will serve as a fixture during the quenching process so that a quenched finished product with a complex shape and very good size accuracy is obtained. To obtain a good fixing of the moulded hollow casing billet 6 against the moulding tool 1 during the whole of the quenching process, pressure fluctuations in the interior of the hollow casing billet 6 should be avoided when the heated medium is replaced by the essentially cooling medium for the quenching.

Figure 3:
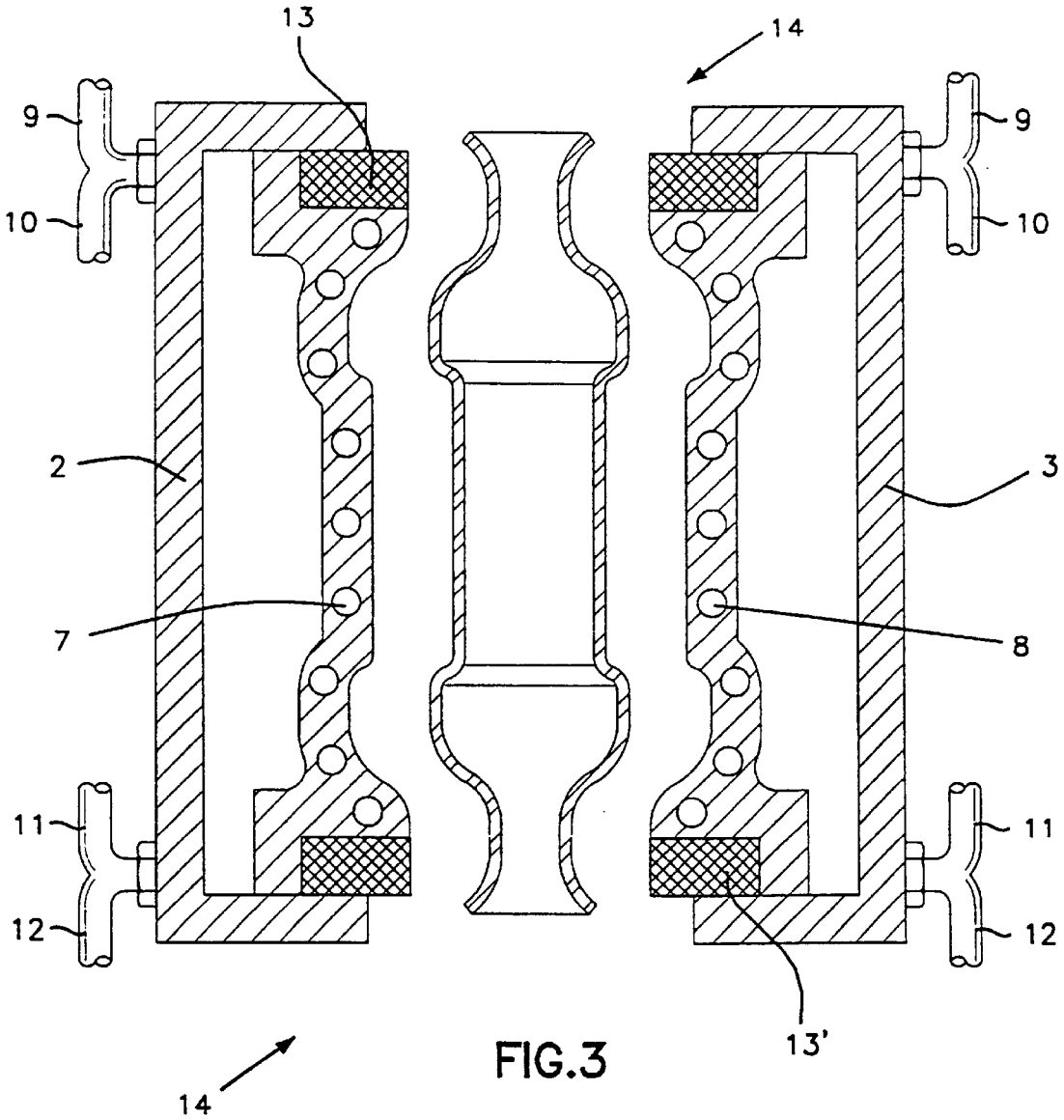
FIG. 3 shows the arrangement according to FIG. 1 during a third stage of the process.
Figure 2A:
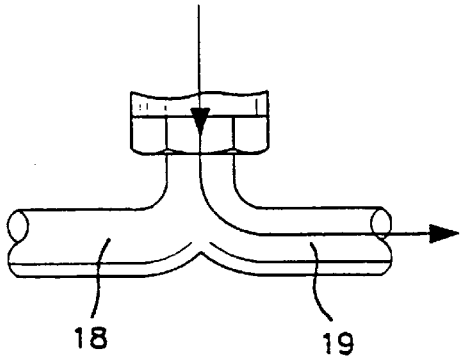
FIG. 2*a* shows one part of the arrangement during part of the process.
Figure 2:
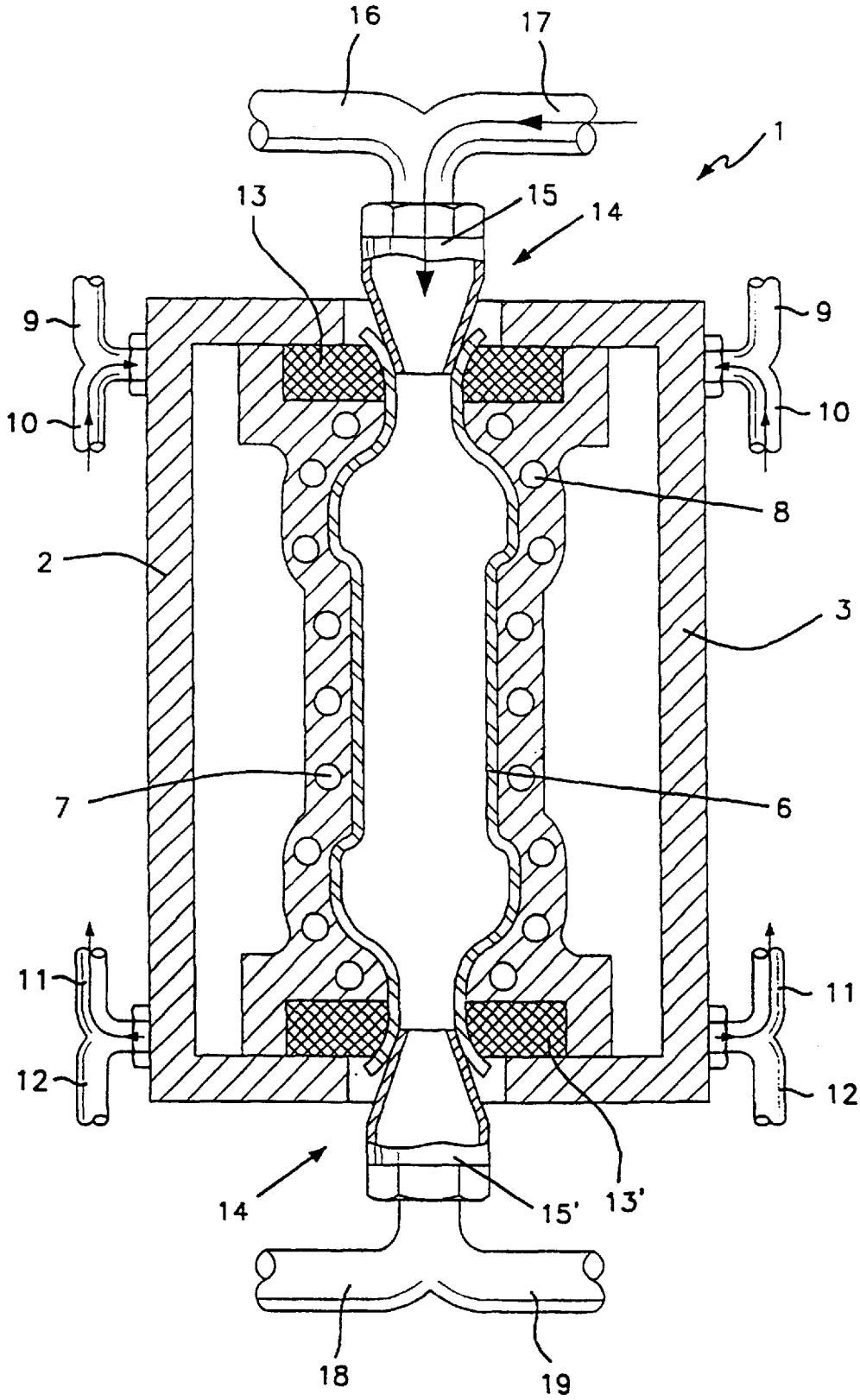
FIG. 2 shows the arrangement according to FIG. 1 during a second stage of the process.

After the quenching has been completed, the cooling gaseous medium is led away out of the moulded hollow casing billet's 6 interior, as is illustrated in FIG. 2*a,* and the finished hollow casing billet is removed from the moulding tool, as illustrated in FIG. 3.

The present invention is, however, not limited to that described above and illustrated in the drawings, but can be changed and modified in a number of different ways within the scope of the invention. For example, it should be realised that the procedure according to the invention is not limited to hollow casings in the form of a tube with two open ends, but that, depending on the design of the moulding tool, the method is possible to utilise even for hollow casings with very complex shapes and with one or more openings.

What is claimed is:

1. A process for preparing a quenched hollow casing of steel by blow molding, the process including the steps of (a) preheating a hollow casing billet to a quenching temperature;

(b) introducing the hollow casing billet into a blow molding tool having inner molding walls;

(c) molding the hollow casing billet by expanding the hollow casing billet against the inner molding walls of the molding tool by injecting a preheated, pressurized medium into an interior cavity of said hollow casing billet; and (d) quenching the hollow casing billet by replacing the preheated, pressurized medium with a pressurized cooling medium, including circulating the pressurized cooling medium through the molding tool and the interior cavity to achieve a rapid cooling effect on said hollow casing billet.

2. The process according to claim 1, wherein the hollow casing billet includes at least two openings for feeding and removing respectively the pressurized heating medium and the pressurized cooling medium to be circulated through the interior cavity of said hollow casing billet.

3. The process according to claim 2, wherein the pressurized heating medium and the pressurized cooling medium are gaseous.

4. The process according to claim 3, wherein air is used as the pressurized heating medium and the pressurized cooling medium.

5. The process according to claim 1, wherein the blow molding tool is preheated prior to the introduction of the hollow casing billet.

6. The process according to claim 5, wherein the blow molding tool is preheated before the step of introducing the hollow casing billet into the blow molding tool by circulating a heated medium through the blow molding tool.

7. The process according to claim 6, wherein water is used as the heating medium for the blow molding tool.

8. The process according to claim 1, wherein the hollow casing billet is made of boron-steel.

9. The process according to claim 1 wherein the hollow casing billet is a tubular beam adapted for use in a vehicle body.

* * * * *